US007121748B1

(12) United States Patent
Sawai

(10) Patent No.: US 7,121,748 B1
(45) Date of Patent: Oct. 17, 2006

(54) IMAGE FORMING DEVICE

(75) Inventor: Kunio Sawai, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 11/376,143

(22) Filed: Mar. 16, 2006

(30) Foreign Application Priority Data

Mar. 25, 2005 (JP) ..... 2005-087802

(51) Int. Cl.
*B41J 2/315* (2006.01)

(52) U.S. Cl. ..... 400/120.16; 400/120.17; 347/197; 347/198

(58) Field of Classification Search ..... 400/120.16, 400/120.17; 347/197, 198; *B41J 25/304, B41J 25/312*
See application file for complete search history.

(56) References Cited

U.S. PATENT DOCUMENTS 5,272,488 A * 12/1993 Kim ..... 347/220
6,682,239 B1 * 1/2004 Mori et al. ..... 400/649
6,972,782 B1 * 12/2005 Terao et al. ..... 347/203

FOREIGN PATENT DOCUMENTS

JP 08-169163 A 7/1996
JP 2001-063106 A 3/2001
JP 2004-255730 A 9/2004

* cited by examiner

*Primary Examiner*—Daniel J. Colilla
*Assistant Examiner*—Marissa Ferguson-Samreth
(74) *Attorney, Agent, or Firm*—Global IP Counselors, LLP

(57) ABSTRACT

The image forming device includes a chassis; a thermal head unit pivotably supported by the chassis for executing printing; a platen roller supported by the chassis opposite the thermal head unit; a pressing member that is pivotably supported by the chassis and configured to press the thermal head unit against the platen roller by pushing against a top portion of the thermal head unit; a protruding part that is provided on the top portion of the thermal head unit and configured to engage the pressing member in a horizontal direction as the pressing member is pivoted to press the thermal head unit against the platen roller; and a positioning member configured to engage the thermal head unit as the thermal head unit is pushed in the horizontal direction due to the engagement of the protruding part with the pressing member in the horizontal direction.

8 Claims, 11 Drawing Sheets

PRIOR ART

IMAGE FORMING DEVICE

BACKGROUND OF THE INVENTION

1. Field of the Invention

The present invention relates to an image forming device. More specifically, the present invention relates to an image forming device equipped with a member that presses a thermal head unit.

2. Background Information

Various structures of thermal transfer printers and other image forming devices have been proposed which include a member for pushing a thermal head or print head.

An image forming device is a known example of the thermal transfer printer. FIG. 18 is a perspective view showing the overall structure of a known example of a thermal transfer printer. FIGS. 19 to 21 illustrate the thermal transfer printer shown in FIG. 18 in more detail. This thermal transfer printer will now be described with reference to FIGS. 18 to 21.

As shown in FIGS. 18 to 21, this thermal transfer printer includes a metal chassis 101, an ink ribbon cartridge 102, a take-up reel 103 (see FIGS. 19 and 20), a thermal head unit 104 for executing printing, a platen roller 105 (see FIG. 21) arranged opposite the thermal head unit 104, platen roller bearings 106 configured and arranged to rotatably support the platen roller 105, pressing member 107, a resin drive gear unit 108 for pivoting the pressing member 107 that has a small diameter gear 108*a* and a large diameter gear 108*b*, a metal feed roller 109 (see FIG. 19) for feeding printer paper 130, a metal pressing roller 110 (see FIG. 19) arranged to press against the feed roller 109 with a prescribed pressing force, feed roller bearings 111 configured and arranged to rotatably support the feed roller 109, pressing roller bearings 112 (see FIG. 19) configured and arranged to rotatably support the pressing roller 110, bearing support plates 113, a helical coil spring 114 (see FIG. 21), tension coil springs 115, an electric motor 116 (see FIGS. 19 and 20) for driving the feed roller 109 and the take-up reel 103, an electric motor 117 for driving the pressing member 107, a motor bracket 118, a feed roller gear 119 (see FIGS. 19 and 20), a swing gear 120 (see FIGS. 19 and 20), and intermediate gears 121 and 122 (see FIG. 20).

As shown in FIGS. 18 and 19, the motor bracket 118 is mounted to one side panel 101*a* of the chassis 101. A cartridge insertion hole 101*c* for inserting the ink ribbon cartridge 102 is formed on the opposite side panel 101*b* of the chassis 101. Insertion holes 101*d* for supporting the pressing member 107 are formed on both side panels 101*a*, 101*b* of the chassis 101. One end of each tension coil spring 115 is attached to a spring attaching hole 101*e* provided in the side panels 101*a*, 101*b* of the chassis 101.

As shown in FIG. 18, the ink ribbon cartridge 102 has a take-up part 102*a* and a supply part 102*b*. A take-up bobbin (not shown) and a supply bobbin 102*c* (see FIG. 21) are arranged inside the take-up part 102*a* and the supply part 102*b* of the ink ribbon cartridge 102, respectively. The ink ribbon 102*d* is wound onto the take-up bobbin and the supply bobbin 102*c*. The take-up reel 103 functions to take up the ink ribbon 102*d* that is wound onto the take-up bobbin and the supply bobbin 102*c* by engaging with the take-up bobbin. As shown in FIGS. 19 and 20, the gear 103*a* of the take-up reel 103 is arranged such that it meshes with the take-up bobbin when the swing gear 120 swings. The swing gear 120 is constantly meshed with the feed roller gear 119.

As shown in FIGS. 18, 19, and 21, the thermal head unit 104 has a support shaft 104*a*, arm parts 104*b*, and a thermal head 104*c*. Support holes 104*d* are formed on the arm parts 104*b*. As shown in FIGS. 19 and 21, the thermal head unit 104 is mounted within the side panels 101*a*, 101*b* of the chassis 101 such that it can pivot about the support shaft 104*a*. A gap is provided between the support shaft 104*a* and each support hole 104*d* for dimensional tolerance. Also, as shown in FIG. 21, the helical coil spring 114 is attached to the support shaft 104*a* of the thermal head unit 104 on the side of the support shaft 104*a* close to the side panel 101*a* of the chassis 101. The helical coil spring 114 functions to urge the thermal head unit 104 in a direction away from the platen roller 105. As shown in FIGS. 18 and 19, bent parts 104*e* configured to be pressed by the pressing member 107 are provided on the arm parts 104*b* of the thermal head unit 104. Also, as shown in FIG. 21, the thermal head 104*c* of the thermal head unit 104 is arranged such that it presses against the platen roller 105 with the printer paper 130 and the ink ribbon 102*d* in between.

As shown in FIGS. 18 and 19, the pressing member 107 includes a pivot member 107*a* arranged on the side closer to the side panel 101*a* of the chassis 101 and having a toothed part 107*d*, a pivot member 107*b* arranged on the side closer to the side panel 101*b* of the chassis 101, and a support rod 107*c*. Pressing springs 107*e* configured and arranged to press the bent parts 104*e* of the thermal head unit 104 are attached to the pivot members 107*a* and 107*b*. The pivot members 107*a* and 107*b* are attached to the support rod 107*c* so as not to be relatively rotatable. As shown in FIG. 21, the toothed part 107*d* of the pivot member 107*a* on the side near the side panel 101*a* of the chassis 101 is arranged such that it meshes with the small diameter gear 108*a* of the drive gear unit 108. The drive gear unit 108 is mounted to the side panel 101*a* of the chassis 101 and functions to transfer drive force from the electric motor 117 to the toothed part 107*d* of the pivot member 107*a*.

As shown in FIGS. 19 and 20, the feed roller 109 is provided at both ends with bearing support sections 109*a* each having a smaller shaft diameter than the outermost diameter of the feed roller 109, gear mounting sections 109*b*, and print paper feeding sections 109*c*. As shown in FIG. 19, the bearing support sections 109*a* of the feed roller 109 are rotatably supported by the feed roller bearings 111. As shown in FIGS. 19 and 20, the gear mounting section 109*b* of the feed roller 109 is inserted into the feed roller gear 119 so as to be relatively unrotatable. Protrusions of a prescribed height are formed by form rolling on the surface of the printer paper feeding sections 109*c* of the feed roller.

As shown in FIG. 19, the pressing roller 110 is provided with bearing support sections 110*a* having smaller shaft diameters than the outermost diameter of the rest of the pressing roller 110. The bearing support sections 110*a* of the pressing roller 110 are rotatably supported on the pressing roller bearings 112. The pressing roller bearings 112 are mounted to the bearing support plates 113, which are provided on the inner sides of the side panels 101*a*, 101*b* of the chassis 101. Each of the bearing support plates 113 is mounted to the inner sides of the side panels 101*a*, 101*b* of the chassis 101 so as to be pivotable about a fulcrum part 113*a*. Each of the bearing support plates 113 also has a spring attaching part 113*b* on which the other end of the respective tension coil spring 115, which urges the pressing roller 110 toward the feed roller 109, is attached. The electric motor 116 is mounted to the motor bracket 118 and serves to drive the feed roller 109 and the take-up reel 103. The driving force of the electric motor 116 is transmitted to the feed roller gear 119 and the gear 103*a* of the take-up reel 103 through the intermediate gears 121 and 122.

The printing operation of this thermal transfer printer will now be explained with reference to FIGS. 20 and 21. When the electric motor 116 rotates, the motor gear 116*a* mounted to the shaft of the motor 116 rotates in the direction of the arrow A2 as shown in FIG. 20 and drives the feed roller gear 119 in the direction of the arrow B2 shown in FIG. 20 through the intermediate gears 121 and 122. When the feed roller 109 rotates in the direction of the arrow B2 as shown in FIGS. 20 and 21, the printer paper 130 is fed in the paper feeding direction (direction of the arrow C2 shown in FIG. 21). When this occurs, the swing gear 120 that is swingably coupled to the feed roller gear 119 meshes with the gear 103*a* of the take-up reel 103 and rotates the gear 103*a* in the direction of the arrow D2 as shown in FIG. 20.

When the gear 103*a* rotates in the direction of the arrow D2, the take-up bobbin (not shown), which meshes with the take-up reel 103, rotates and thereby causes the ink ribbon 102*d* (which is wound onto the take-up bobbin and the supply bobbin 102*c*) to be taken up. While the printer paper 130 and the ink ribbon 102*d* are being fed, the drive force of the electric motor 117 is transmitted to the pivot members 107*a* and 107*b* of the pressing member 107 through the small diameter gear 108*a* of the drive gear unit 108, thereby causing the pressing springs 107*e* to press against the bent parts 104*e* of the thermal head unit 104. As a result, the thermal head 104*c* of the thermal head unit 104 presses against the platen roller 105 with the printer paper 130 and the ink ribbon 102*d* sandwiched therebetween. In this manner, printing takes place.

In the thermal transfer printer shown in FIGS. 18 to 21, the support shafts 104*a* fit into support holes 104*d* provided in the arm parts 104*b* to support the thermal head unit 104 in a pivotable manner, with a gap being provided between the support shaft 104*a* and each support hole 104*d* for dimensional tolerance. When the thermal head unit 104 is pivoted, the positioning of the thermal head unit 104 with respect to the platen roller 105 tends to become misaligned due to the gap. As a result, the printing accuracy tends to be compromised.

In view of the above, it will be apparent to those skilled in the art from this disclosure that there exists a need for an improved image forming device that overcomes the problems of the art. This invention addresses this need in the art as well as other needs, which will become apparent to those skilled in the art from this disclosure.

SUMMARY OF THE INVENTION

The present invention provides an image forming device configured such that the thermal head unit can be readily and easily positioned with respect to the platen roller, without having to compromise the print quality.

The image forming device in accordance with the first aspect of the present invention includes a chassis; a thermal head unit pivotably supported by the chassis for executing printing; a platen roller supported by the chassis opposite the thermal head unit; a pressing member that is pivotably supported by the chassis and configured to press the thermal head unit against the platen roller by pushing against a top portion of the thermal head unit; a protruding part that is provided on the top portion of the thermal head unit and configured to engage the pressing member in a horizontal direction as the pressing member is pivoted to press the thermal head unit against the platen roller; and a positioning member configured to engage the thermal head unit as the thermal head unit is pushed in the horizontal direction due to the engagement of the protruding part with the pressing member in the horizontal direction.

The image forming device in accordance with this aspect of the present invention includes the pressing member configured and arranged to press the thermal head unit against the platen roller by pushing against a top portion of the thermal head unit. The protruding part is provided on the top portion of the thermal head unit and configured such that when the pressing member touches the protruding part, the pressing member thereby exerts a force that pushes the thermal head unit in the horizontal direction. Furthermore, the positioning member is configured and arranged to touch against the thermal head unit. Thus, when the pressing member presses the thermal head unit against the platen roller, the pressing member and the protruding part can cause the thermal head unit to be pushed and moved in the horizontal direction in such a fashion that the thermal head unit touches against the positioning member. Consequently, the thermal head unit can be easily and stably positioned with respect to the platen roller when the pressing member pushes the thermal head unit. As a result, the print quality can be improved.

In the image forming device in accordance with the second aspect of the present invention, it is preferable that the protruding part is arranged such that the pressing member is configured to engage the protruding part in the horizontal direction before the pressing member reaches the pivot endpoint as the pressing member pivots toward its pivot endpoint.

When the protruding part is arranged in such a fashion, the pressing member moves a small amount in the pivot direction after it contacts the protruding part. Consequently, the thermal head unit can be readily moved in the horizontal direction and made to touch against the positioning member. As a result, the pressing member can easily move the thermal head unit in the horizontal direction and position the thermal head unit with respect to the platen roller, while pressing the thermal head unit against the platen roller.

In the image forming device in accordance with the third aspect of the present invention, it is preferable to further provide a feed roller rotatably supported by the chassis for feeding printer paper and a feed roller bearing supported by the chassis and configured to rotatably support the feed roller. Furthermore, it is preferable that the positioning member is formed on the feed roller bearing.

When such an arrangement is adopted, there is no need to increase the number of parts of the image forming device in comparison with configurations in which a separate positioning member is provided.

In the image forming device in accordance with the fourth aspect of the present invention, it is preferable that the protruding part be formed integrally with the thermal head unit. By forming the protruding part integrally, there is no need to increase the number of parts of the image forming device when the protruding part is to be provided.

In the image forming device in accordance with the fifth aspect of the present invention, it is preferable that the thermal head unit be pivotably mounted to the chassis with a support shaft so as to be further movable in the horizontal direction. By providing the thermal head unit in such a fashion, the thermal head unit can be readily moved in the horizontal direction by the horizontal pressing force that is generated when the pressing member contacts the protruding part. As a result, the thermal head unit can be made to touch against the positioning member in a reliable manner.

In the image forming device in accordance with the sixth aspect of the present invention, it is preferable that the positioning member have a projecting part that projects in the horizontal direction formed thereon, and the projecting part be configured to engage the thermal head unit as the thermal head unit is pushed in the horizontal direction.

In the image forming device in accordance with the seventh aspect of the present invention, it is preferable that the thermal head unit have a projecting part that projects in the horizontal direction formed thereon, and the projecting part be configured to engage the positioning member as the thermal head unit is pushed in the horizontal direction.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Specific embodiments of the present invention will now be described with reference to the drawings.

First Embodiment

Figure 1:
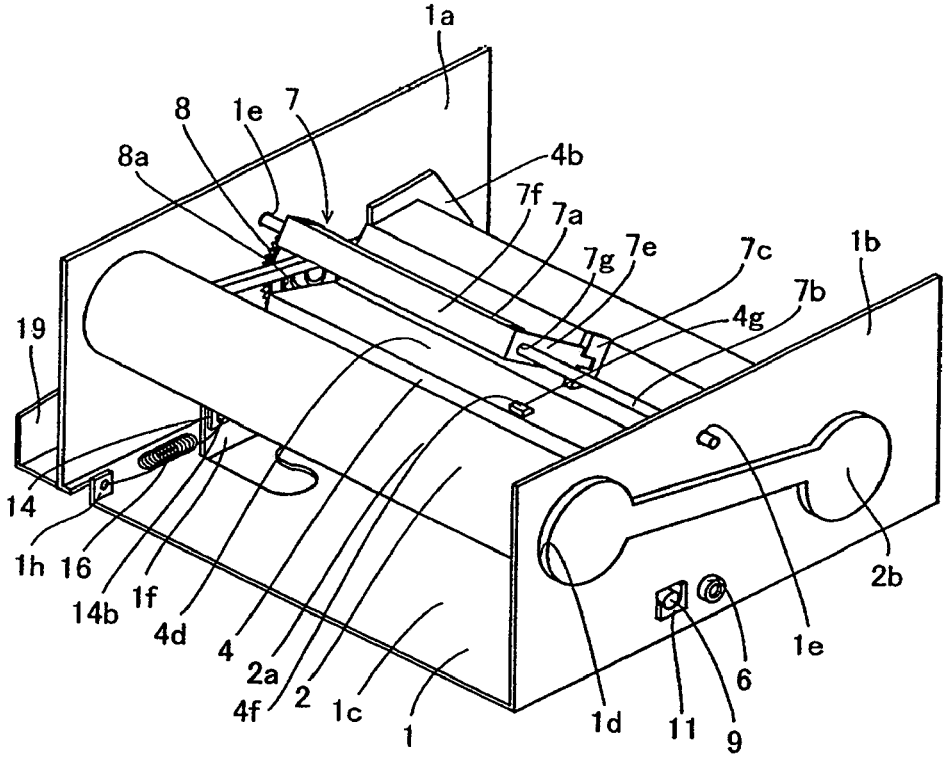
FIG. 1 is a perspective view showing the overall structure of a thermal transfer printer in accordance with a first embodiment of the present invention.

FIG. 1 is a perspective view showing the overall structure of a thermal transfer printer in accordance with a first embodiment of the present invention. FIGS. 2 to 14 illustrate the constituent features of a thermal transfer printer in accordance with the first embodiment of the present invention in more detail. The structure of the thermal transfer printer in accordance with the first embodiment of the present invention will now be described with reference to FIGS. 1 to 14. This embodiment illustrates a case in which the present invention is applied to a thermal transfer printer, which is one example of an image forming device.

Figure 2:
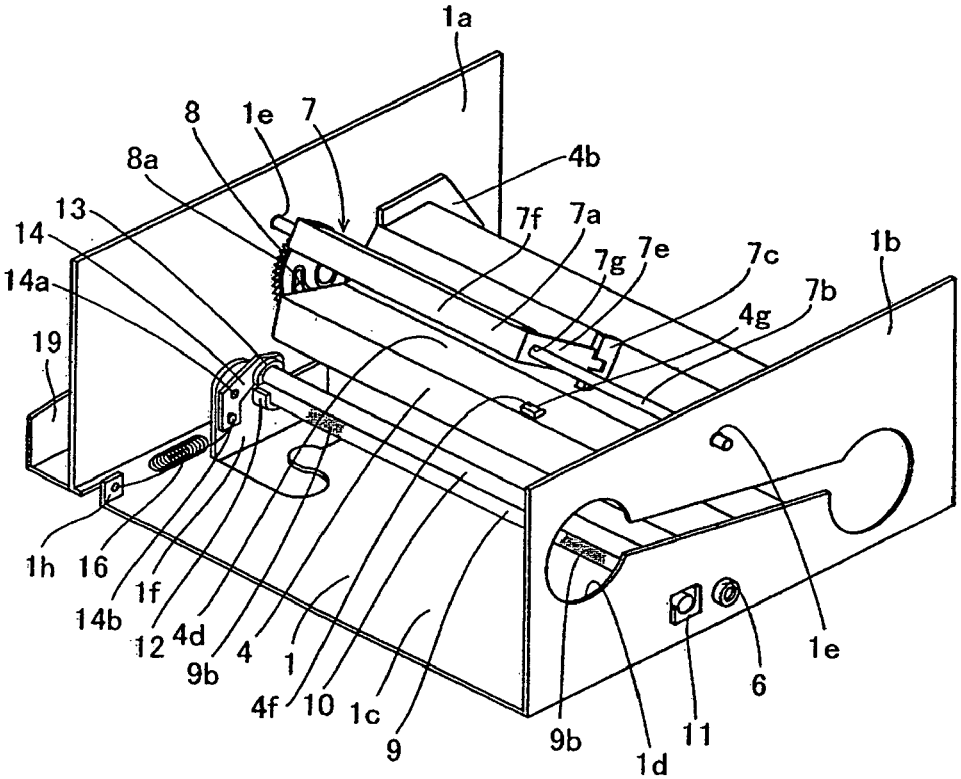
FIG. 2 is a perspective view of the thermal transfer printer in accordance with the first embodiment of the present invention shown in FIG. 1, illustrated with the ink ribbon cartridge being removed.
Figure 3:
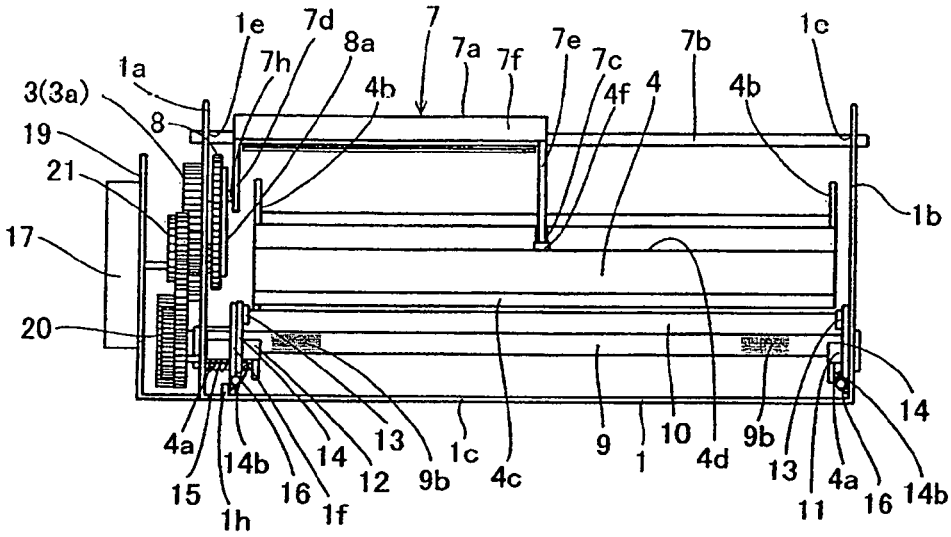
FIG. 3 is a frontal view of the thermal transfer printer in accordance with the first embodiment of the present invention shown in FIG. 1, illustrated with the ink ribbon cartridge being removed.
Figure 4:
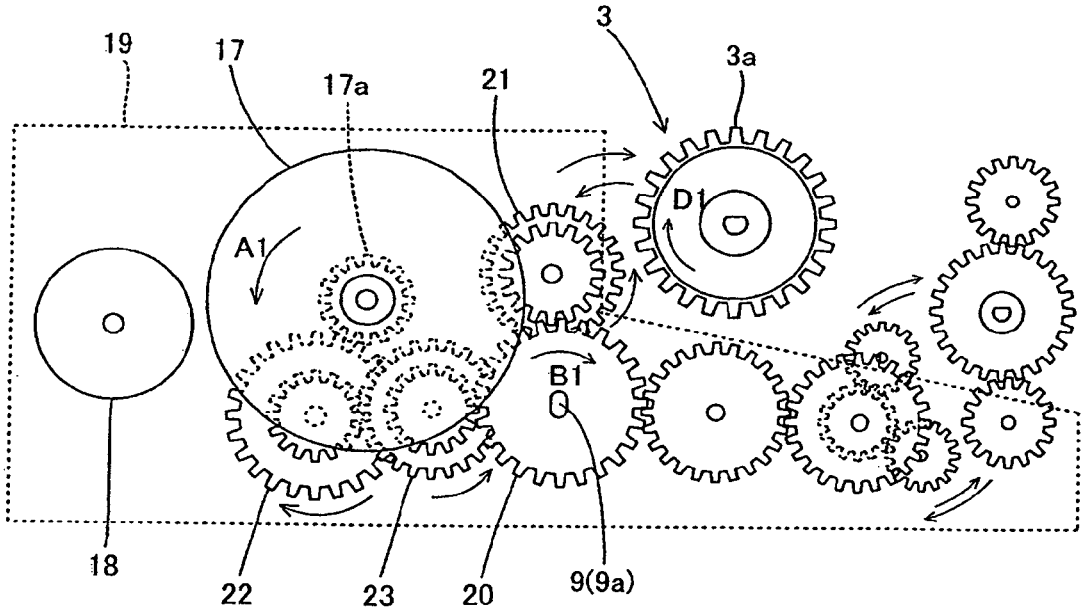
FIG. 4 is a schematic side view of the electric motors and gears of the thermal transfer printer in accordance with the first embodiment of the present invention shown in FIG. 1.

As shown in FIGS. 1 to 4 and FIG. 10, the thermal transfer printer in accordance with the first embodiment of the present invention includes: a metal chassis 1, an ink ribbon cartridge 2, a take-up reel 3 (see FIG. 4), a thermal head unit 4 for executing printing, a platen roller 5 (see FIG. 10) arranged opposite the thermal head unit 4, platen roller bearings 6 configured and arranged to rotatably support the platen roller 5, a pressing member 7, a resin cam gear 8 having a cam groove 8*a*, a metal feed roller 9 (see FIG. 2)

for feeding printer paper 30, a metal pressing roller 10 (see FIG. 2) arranged to press against the feed roller 9 with a prescribed pressing force, feed roller bearings 11 and 12 configured and arranged to rotatably support the feed roller 9, pressing roller bearings 13 (see FIG. 2) configured and arranged to rotatably support the pressing roller 10, bearing support plates 14, a helical coil spring 15 (see FIGS. 3 and 10), tension coil springs 16, an electric motor 17 (see FIG. 3) for driving the feed roller 9 and the take-up reel 3, an electric motor 18 for driving the pressing member 7, a motor bracket 19, a feed roller gear 20 (see FIG. 4), a swing gear 21 (see FIG. 4), and intermediate gears 22 and 23 (see FIG. 4).

Figure 6:
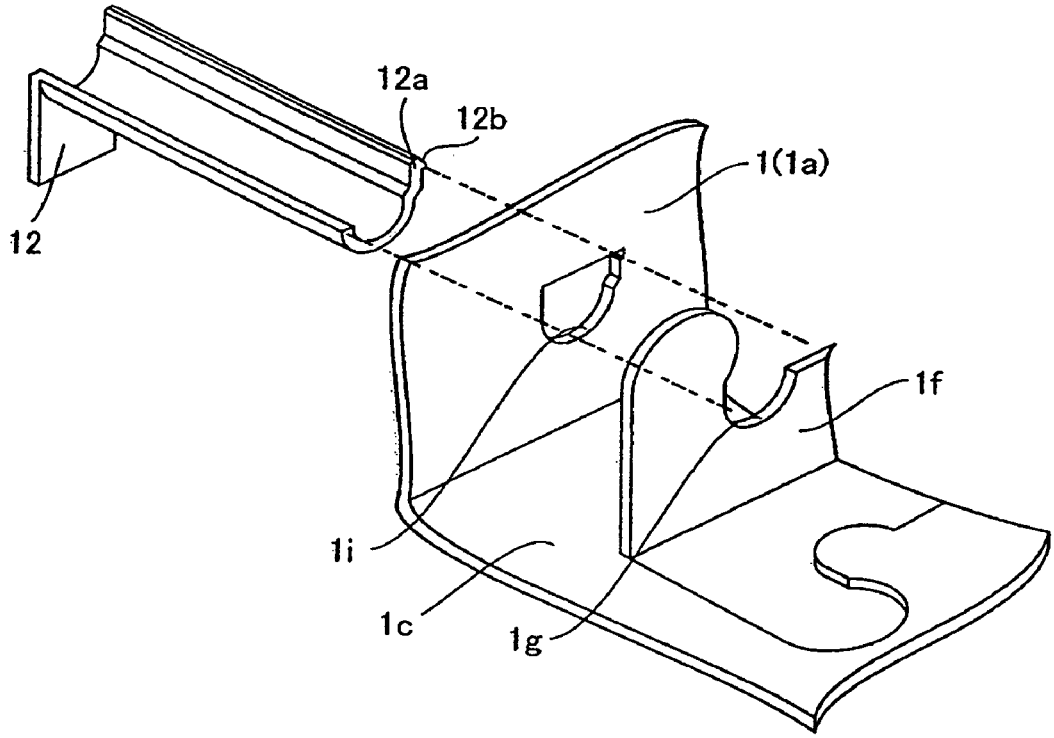
FIG. 6 is a partial perspective view illustrating the mounting structure of a feed roller bearing of the thermal transfer printer in accordance with the first embodiment of the present invention shown in FIG. 1.
Figure 7:
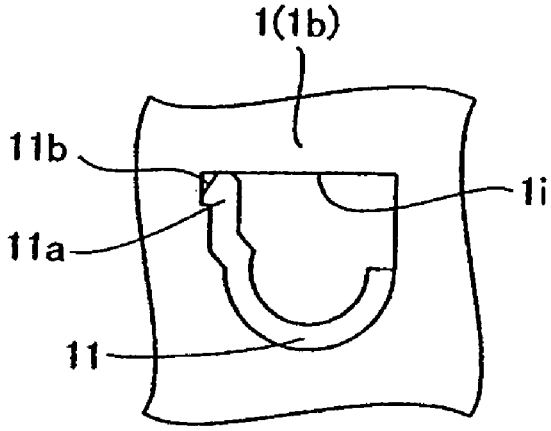
FIG. 7 is a frontal view of the feed roller bearing of the thermal transfer printer in accordance with the first embodiment of the present invention shown in FIG. 1.

As shown in FIGS. 1 and 2, the chassis 1 has a first side panel 1*a*, a second side panel 1*b*, and a bottom panel 1*c*. The motor bracket 19 is mounted to the first side panel 1*a* of the chassis 1. A cartridge insertion hole 1*d* for inserting the ink ribbon cartridge 2 is formed on the second side panel 1*b*, which is opposite the first side panel 1*a*, of the chassis 1. An insertion hole 1*e* for pivotably supporting the pressing member 7 is provided in each of the side panels 1*a*, 1*b* of the chassis 1. A bent piece 1*f* formed by inserting a cut in a portion of the bottom panel 1*c* and bending the cut portion into an upright orientation is provided on the bottom panel 1*c* of the chassis 1. As shown in FIG. 6, a feed roller bearing support part 1*g*, which is a concaved portion for supporting the feed roller bearing 11, is provided on the bent piece 1*f*. As shown in FIGS. 1 and 2, spring attaching parts 1*h*, onto which one end of each tension coil spring 16 is attached, are provided on the bottom panel 1*c* of the chassis 1.

As shown in FIG. 1, the ink ribbon cartridge 2 has a take-up part 2*a* and a supply part 2*b*. A take-up bobbin (not shown) and a supply bobbin 2*c* (see FIG. 10) are arranged inside the take-up part 2*a* and supply part 2*b* of the ink ribbon cartridge 2, respectively. An ink ribbon 2*d* is wound onto the take-up bobbin and the supply bobbin 2*c*. The take-up reel 3 engages with the take-up bobbin and thereby functions to take up the ink ribbon 2*d* that is wound onto the take-up bobbin and the supply bobbin 2*c*. As shown in FIG. 4, the gear 3*a* of the take-up reel 3 is arranged such that it meshes with the take-up bobbin when the swing gear 21 swings toward the gear 3*a*. The swing gear 21 is always meshed with the feed roller gear 20.

Figure 9:
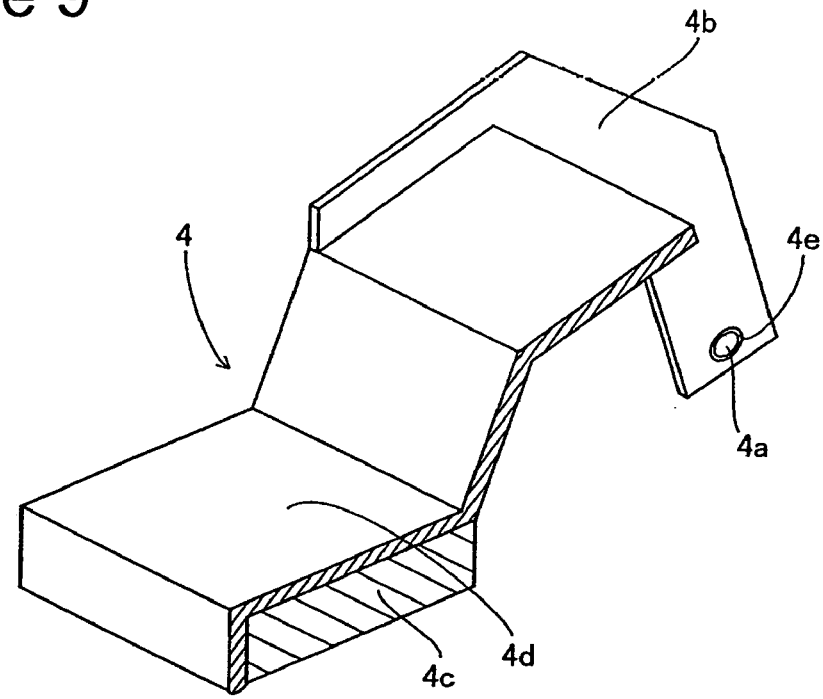
FIG. 9 is a partial perspective view of the thermal head unit of the thermal transfer printer in accordance with the first embodiment of the present invention shown in FIG. 1.
Figure 10:
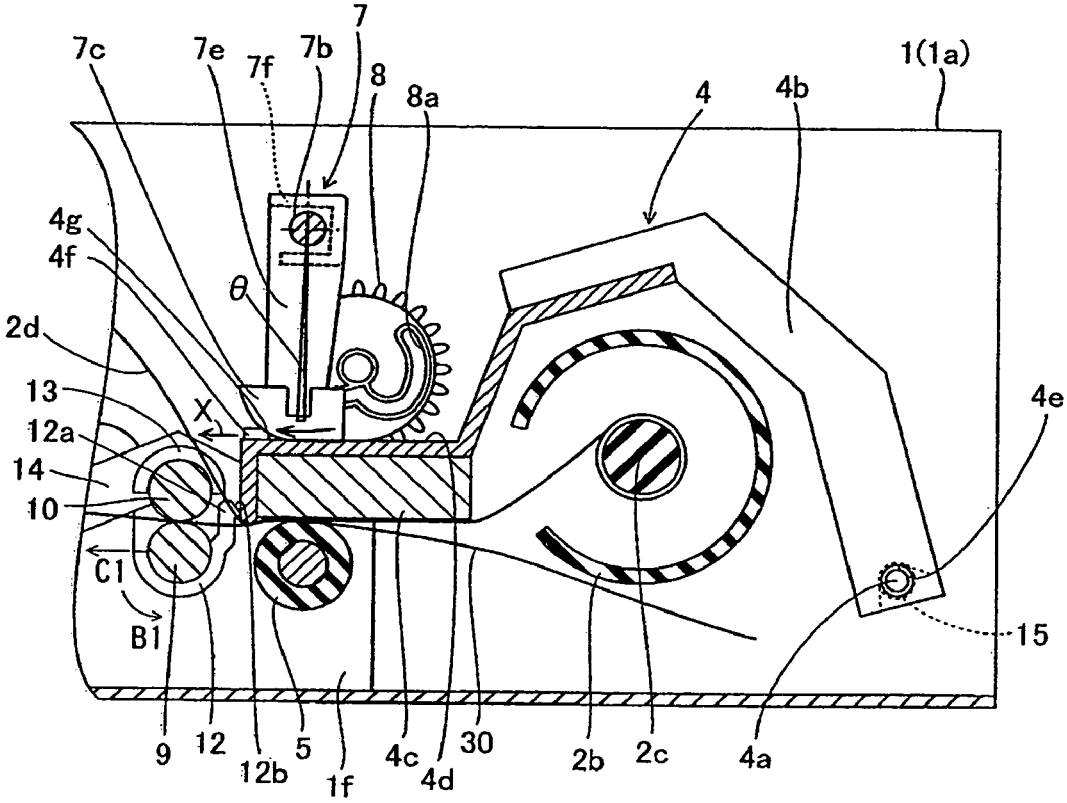
FIG. 10 is a schematic side view showing the thermal head unit being pressed by the pressing member in the thermal transfer printer in accordance with the first embodiment of the present invention shown in FIG. 1.

As shown in FIGS. 9 and 10, the thermal head unit 4 has support shafts 4*a* that serve as the pivotal center for the thermal head unit 4, arm parts 4*b*, a thermal head 4*c*, a heat sink 4*d* for cooling the thermal head 4*c*, and support holes 4*e*.

In the first embodiment, a protruding part 4*f*, which is configured to engage a cap part 7*c* of the pressing member 7 in a horizontal direction, is formed integrally and unitarily with the heat sink 4*d* of the thermal head unit 4 by, for example, press work. The protruding part 4*f* is, as shown in FIGS. 1, 2, 12, and 13, arranged in a generally middle position along the widthwise direction of the heat sink 4*d*. The protruding part 4*f* includes a contact part 4*g* which is shaped so as to be able to achieve a two-dimensional contact with the surface of the cap part 7*c*.

As shown in FIG. 3, the thermal head unit 4 is mounted to the inner sides of the first and second side panels 1*a* and 1*b* of the chassis 1 so as to be able to pivot about the support shafts 4*a*. As shown in FIGS. 9 and 10, the internal diameter of the support holes 4*e* of the thermal head unit 4 of the first embodiment is larger than the outside diameter of the support shafts 4*a*, so that the thermal head unit 4 can pivot about the support shafts 4*a*, and also move in a horizontal direction along the support shafts 4 by a prescribed amount.

As shown in FIGS. 3 and 10, the helical coil spring 15 is attached to the support shaft 4*a* of the thermal head 4 on the side of the first side panel 1*a* of the chassis 1. The helical coil spring 15 functions to spring load the thermal head unit 4 in a direction of separation from the platen roller. As shown in FIG. 10, the thermal head 4*c* of the thermal head unit 4 is arranged to press against the platen roller 5 with the printer paper 30 and the ink ribbon 2*d* sandwiched there-between.

Figure 8:
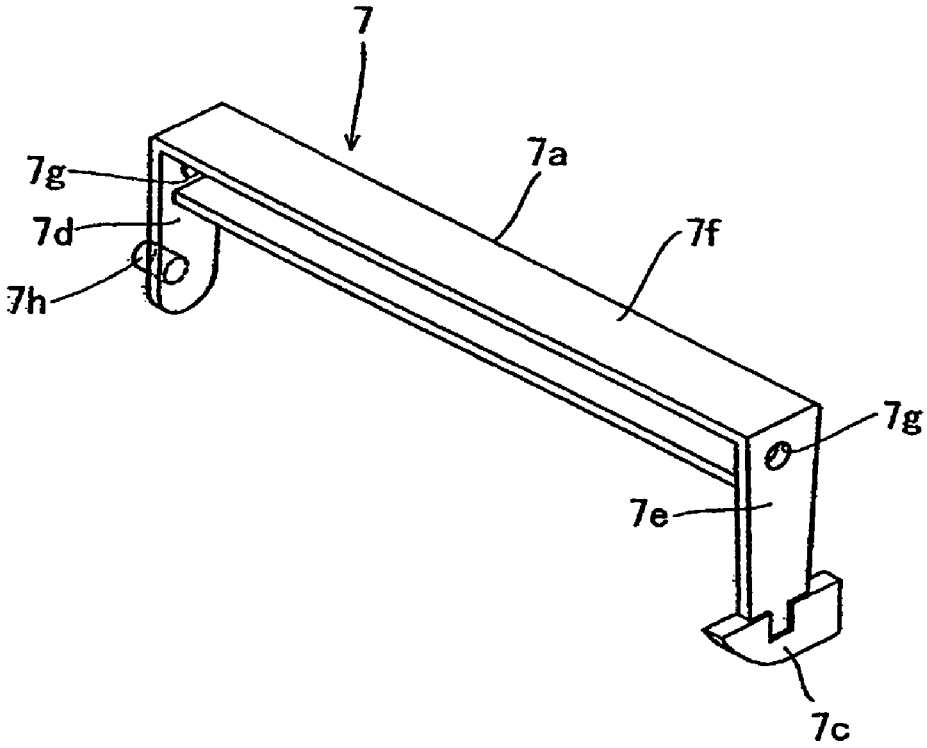
FIG. 8 is a perspective view of the pivot member of the thermal transfer printer in accordance with the first embodiment of the present invention shown in FIG. 1.

As shown in FIGS. 1 to 3 and FIG. 14, the pressing member 7 has a pivot member 7*a*, a support rod 7*b* made of a piano string having a diameter of approximately 3 mm and capable of deflective deformation, and a resin cap part 7*c* having a smaller width (L1) than the width (L2) of the protruding part 4*f*, which is provided on the top of the heat sink 4*d* of the thermal head unit 4. As shown in FIG. 8, the pivot member 7*a* of the pressing member 7 is generally U-shaped and includes a side plate 7*d*, another side plate 7*e*, and a connecting part 7*f* connected between the side plates 7*d* and 7*e*. Holes 7*g* for mounting the support rod 7*b* are provided in both side plates 7*d*, 7*e* of the pivot member 7*a*. A cam pin 7*h* configured to engage with the cam groove 8*a* (see FIGS. 1 to 3) of the cam gear 8, to which drive force is transmitted from the electric motor 18, is provided on the side plate 7*d* of the pivot member 7*a*.

Figure 11:
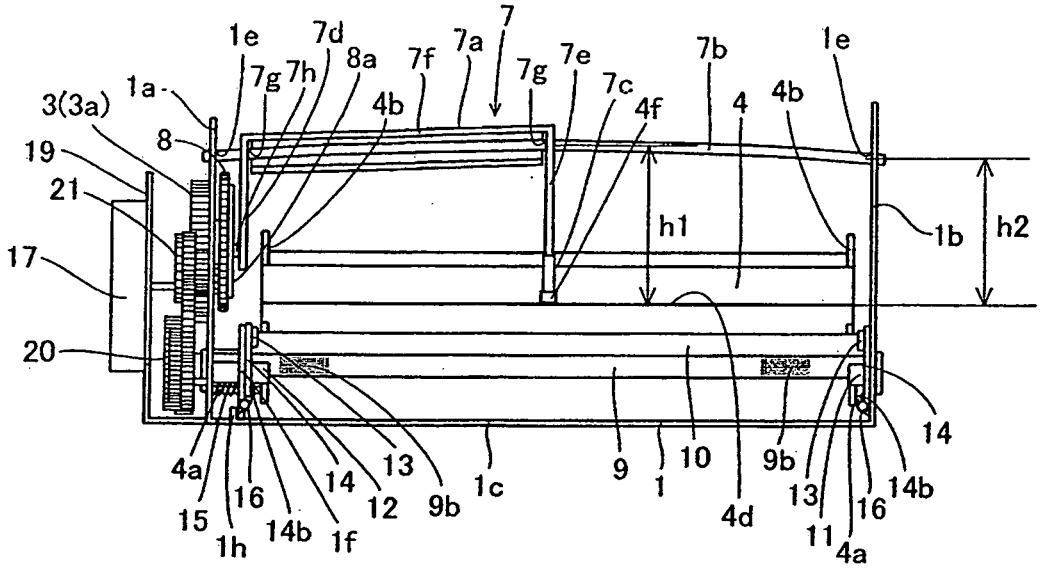
FIG. 11 is a frontal view of the thermal transfer printer in accordance with the first embodiment of the present invention shown in FIG. 1, showing the thermal head unit being pressed by the pressing member.

The resin cap part 7*c* is provided on an end part of the other side plate 7*e* of the pivot member 7*a*. The cap part 7*c* is mounted such that it contacts a top part of the heat sink 4*d* of the thermal head unit 4. As shown in FIG. 11, the height h1 from the bottom surface of the cap part 7*c* to the center of the hole 7*g* in the side plate 7*e* of the pivot member 7*a* is approximately 2.4 mm larger than the height h2, which is from the top of the heat sink 4 to the center of the insertion hole 1*e* of the chassis 1, during the pressing of the thermal head unit 4. Thus, the support rod 7*b* flexes by approximately 2.4 mm in an upward direction during the pressing.

As shown in FIGS. 2 to 4, the metal feed roller 9 is provided with a gear mounting section 9*a* (see FIG. 4) and printer paper feeding sections 9*b*. The feed roller 9 is rotatably supported on the feed roller bearings 11 and 12. As shown in FIG. 4, the gear mounting section 9*a* of the feed roller 9 is fitted into the feed roller gear 20 so as to be relatively unrotatable. Protrusions of a prescribed height are formed by form rolling on the surface of the printer paper feeding sections 9*b* of the feed roller 9. As a result, the printer paper can be fed in a precise fashion.

As shown in FIGS. 2 and 3, the metal pressing roller 10 is rotatably supported by the pressing roller bearings 13. The pressing roller bearings 13 are mounted to the bearing support plate 14 which is provided on the inner side of the second side panel 1*b* of the chassis 1, and the bearing support plate 14 which is the inner side of the bent piece 1*f* provided on the bottom panel 1*c* of the chassis 1. As shown in FIG. 2, the bearing support plates 14 are mounted on the second side panel 1*b* and the bent piece 1*f* so as to be pivotable about the support parts 14*a*. The bearing support plates 14 have spring attaching parts 14*b* to which are attached second ends of the tension coil springs 16. Thus, the tension coil springs 16 serve to urge the pressing roller 10 toward the feed roller 9.

Figure 5:
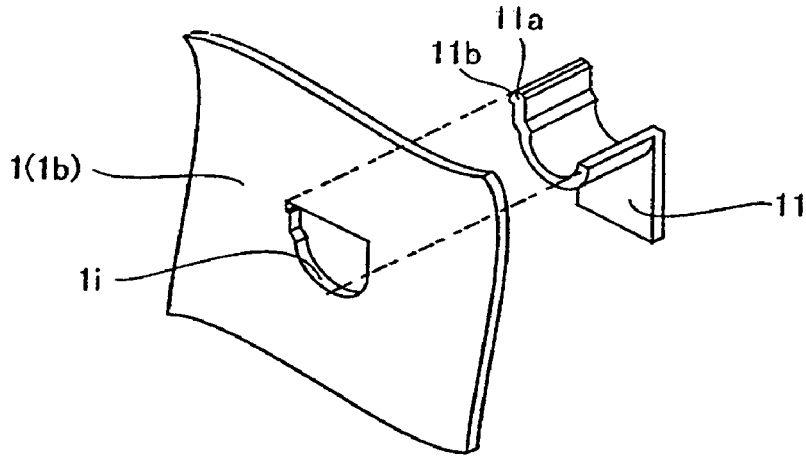
FIG. 5 is a partial perspective view illustrating the mounting structure of a feed roller bearing of the thermal transfer printer in accordance with the first embodiment of the present invention shown in FIG. 1.
Figure 12:
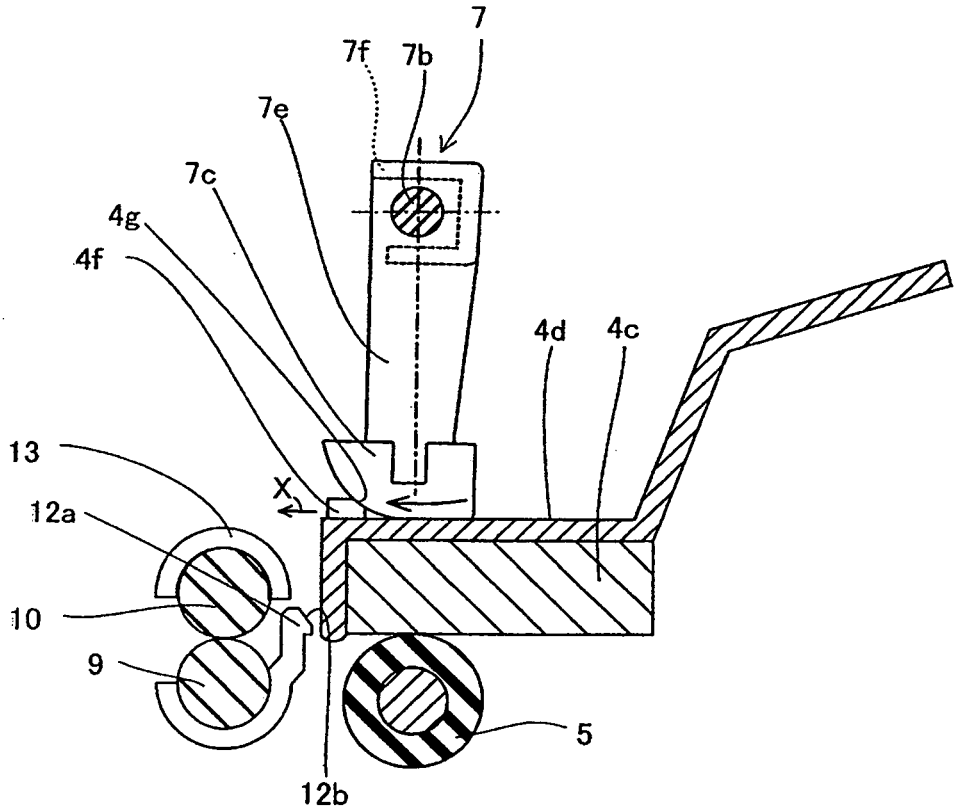
FIG. 12 is a schematic side view showing the pressing member in contact with the protruding part immediately before reaching the pivot endpoint (pressing position) in the thermal transfer printer in accordance with the first embodiment of the present invention shown in FIG. 1.

As shown in FIGS. 11 and 12, the feed roller bearings 11 and 12 in this embodiment are provided with integrally formed positioning parts 11*a* and 12*a*, respectively, which protrude in the horizontal direction are configured to contact the heat sink 4*d* of the thermal head unit 4. In other words, in the first embodiment, the feed roller bearings 11 and 12, through the positioning parts 11*a* and 12*a*, function as positioning members for the thermal head unit 4. As shown in FIG. 5, the feed roller bearing 11 provided on the second side panel 1*b* of the chassis 1 is supported in a bearing support hole 1*i*, which is provided in the second side panel 1*b* of the chassis 1.

As shown in FIG. 6, the feed roller bearing 12 provided on the first side panel 1*a* of the chassis 1 is supported in a bearing support hole 1*i* provided in the first side panel 1*a* of the chassis 1, and on the feed roller bearing support part 1*g* of the bent piece 1*f* provided on the bottom panel 1*c* of the chassis 1. The feed roller bearing 12 provided on the first side panel 1*a* of the chassis 1 is longer in the axial direction than the feed roller bearing 11 provided on the second side panel 1*b* of the chassis 1, so that the feed roller bearing 12 can be supported on the feed roller bearing support part 1*g* of the bent piece 1*f* provided on the bottom panel 1*c* of the chassis 1. Also, tapered parts (chamfered parts) 11*b* and 12*b* are provided on the upper ends of the positioning parts 11*a* and 12*a* of the feed roller bearings 11 and 12.

As shown in FIG. 4, the electric motor 17 for driving the feed roller 9 and the take-up reel 3 is mounted to the motor bracket 19, such that the drive force of the electric motor 17 is transmitted to the feed roller gear 20 and the gear 3*a* of the take-up reel 3 through the intermediate gears 22 and 23.

The pressing action and positioning of the thermal head unit 4, as well as the printing operation of the thermal transfer printer in accordance with the first embodiment of the present invention will now be explained with reference to the FIGS. 3, 4, and 10. First, when the electric motor 18 (see FIG. 4) for driving the pressing member 7 rotates, the cam gear 8 (see FIGS. 3 and 10) turns and transmits the drive force of the electric motor 18 to the cam pin 7*h* (see FIG. 3) of the pressing member 7, which engages the cam groove 8*a* (see FIGS. 3 and 10) of the cam gear 8.

The pivot member 7*a* (see FIG. 3) of the pressing member 7 turns about the support rod 7*b*, and the support rod 7*b* deflects upward. As a result, the cap part 7*c* provided on an end of the side plate 7*e* of the pivot member 7*a* of the pressing member 7 presses against a top portion of the head sink 4*d* of the thermal head unit 4.

Figure 13:
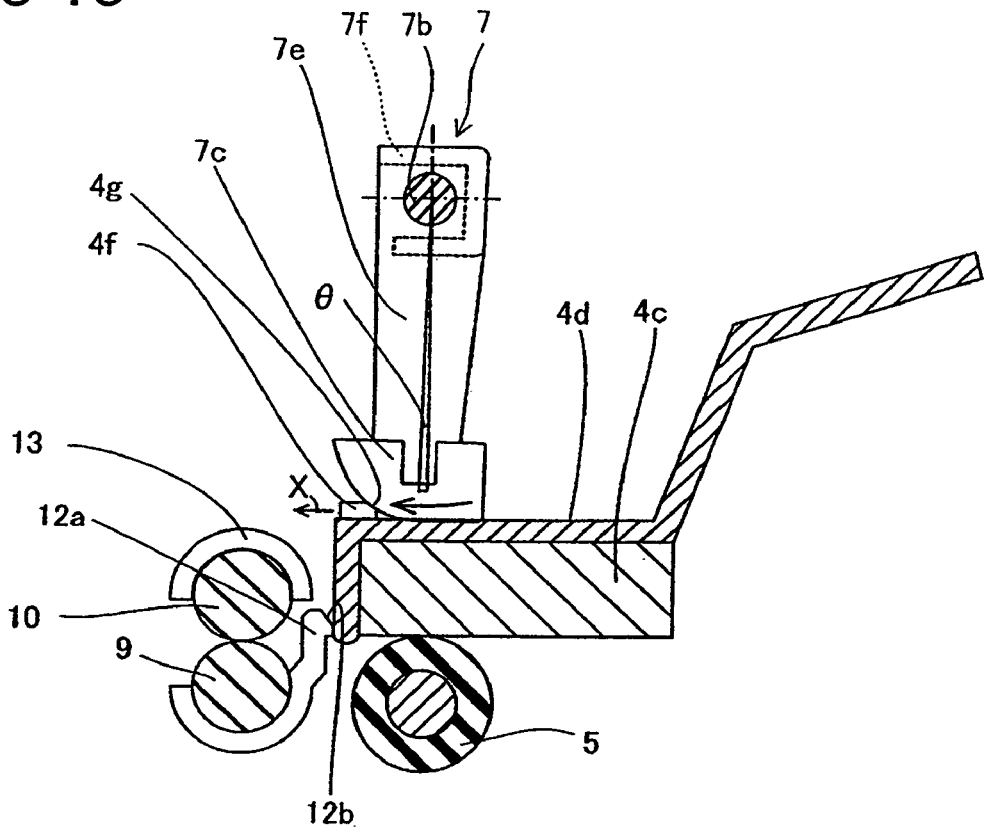
FIG. 13 is a schematic side view showing the pressing member at the pivot endpoint (pressing position) in the thermal transfer printer in accordance with the first embodiment of the present invention shown in FIG. 1.
Figure 14:
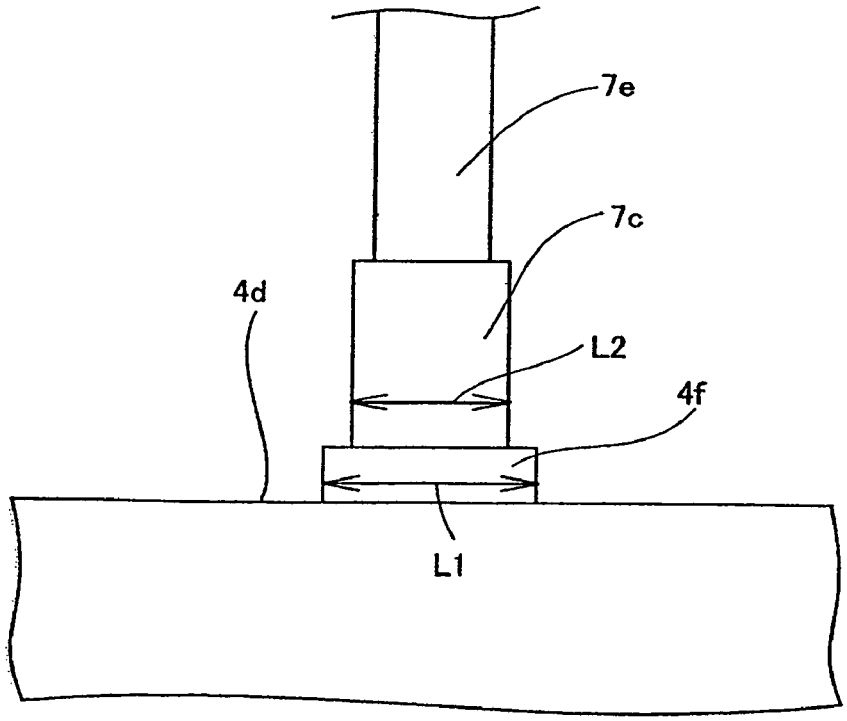
FIG. 14 is a schematic frontal view showing the pressing member in contact with the protruding part in the thermal transfer printer in accordance with the first embodiment of the present invention shown in FIG. 1.

In the first embodiment, as the pressing member 7 pivots about the support rod 7*b* toward a pivot endpoint (pressing position), the cap part 7*c* of the pivot member 7*a* of the pressing member 7 contacts the contact part 4*g* of the protruding part 4*f* provided on the thermal head unit 4 as shown in FIG. 12, immediately before the pressing member 7 reaches its pivoting endpoint. Then, as shown in FIG. 13, the pressing member 7 pivots about the support rod 7*b* by an additional angle of θ until the pressing member 7 reaches the pressing position (pivot endpoint).

As a result, the front part of the thermal head unit 4 moves in the direction indicated with the arrow X (see FIGS. 12 and 13) and touches against the positioning parts 11*a* and 12*a* of the feed roller bearings 11 and 12. Since the inside diameter of the support holes 4*e* of the thermal head unit 4 is larger than the outside diameter of the support shafts 4*a*, the thermal head unit 4 can move in the horizontal direction along the support shaft 4 up to a prescribed amount. When the cap part 7*c* of the pressing member 7 reaches the pressing position (pivot endpoint), the pressing member 7 is pressing the top of the heat sink 4*d* of the thermal head unit 4 with approximately 5 kg. The pressing operation and the positioning operation of the thermal head 4 in accordance with the first embodiment is completed when the pivot endpoint is reached.

After the pressing operation and the positioning operation of the thermal head 4 are completed, the motor gear 17*a* mounted to the shaft part of the electric motor 17 rotates in the direction of the arrow A1 shown in FIG. 4, as the electric motor 17 drives the feed roller 9 and the take-up reel 3. The motor gear 17*a* rotates the intermediate gears 22 and 23 and thereby causes the feed roller gear 20 to rotate in the direction of the arrow B1 shown in FIG. 4. When the feed roller 9 rotates in the direction of the arrow B1 shown in FIG. 4 and FIG. 10, the printer paper 30 is fed in the paper feeding direction of the printing operation (the direction of the arrow C1 shown in FIG. 10). When this occurs, the swing gear 21 that is swingably coupled to the feed roller 9 meshes with the gear 3*a* of the take-up reel 3, and rotates the gear 3*a* in the direction of the arrow D1 shown in FIG. 4. As result, the take-up bobbin (not shown), which engages with the take-up reel 3, rotates and takes up the ink ribbon 2*d* that is wound onto the take-up bobbin and the supply bobbin 2*c*.

While the printer paper 30 and ink ribbon 2*d* are being fed, the thermal head unit 4 is pressed against the platen roller 5 and pressed into contact with the positioning parts 11*a* and 12*a* of the feed roller bearings 11 and 12. As a result, printing can take place while the thermal head unit 4 is stably positioned with respect to the platen roller 5.

As previously described, the thermal transfer printer of the first embodiment is provided with the pressing member 7 that is configured and arranged to press the thermal head unit 4 against the platen roller 5 by pushing against the top portion of the thermal head unit 4. Furthermore, the protruding part 4*f* is provided on the top portion of the thermal head unit 4 and is configured such that the pressing member 7 thereby exerts a force that pushes the thermal head unit 4 in the horizontal direction when the pressing member 7 touches against the protruding part 4*f*. Still furthermore, positioning parts 11*a* and 12*a* are configured and arranged to touch against the thermal head unit 4.

Thus, when the pressing member 7 presses the thermal head unit 4 against the platen roller 5, the pressing member 7 and the protruding part 4*f* can cause the thermal head unit 4 to be pushed and moved in the horizontal direction in such a fashion that the thermal head unit 4 touches against the positioning parts 11*a* and 12*a*. Consequently, the thermal head unit 4 can be easily and stably positioned with respect to the platen roller 5 when the pressing member 7 pushes the thermal head unit 4. As a result, the print quality can be improved.

Additionally, in the first embodiment, the protruding part 4*f* is arranged such that the pressing member 7 contacts the protruding part 4*f* as the pressing member 7 pivots toward the pivot endpoint (pressing position), immediately before the pressing member 7 reaches the pivot endpoint. Therefore, the pressing member 7 moves in the pivot direction by a short distance after the pressing member 7 contacts the protruding part 4*f*. Consequently, the thermal head unit 4 can be readily moved in the horizontal direction and made to touch against the positioning parts 11*a* and 12*a*. As a result, the pressing member 7 can easily move the thermal head unit 4 in the horizontal direction and stably position the thermal head unit 4, while at the same time pressing the thermal head unit 4 against the platen roller 5.

In the first embodiment, since the feed roller bearings 11 and 12 that rotatably support the feed roller 9 are provided with the positioning parts 11*a* and 12*a*, which contact the thermal head unit 4, there is no need to increase the number of parts in comparison with configurations in which separate positioning members are provided.

In the first embodiment, since the protruding part 4*f* is formed integrally with the heat sink 4*d* of the thermal head unit 4, there is no need to increase the number of parts of the thermal transfer printer to provide the protruding part 4*f*.

In a construction in which a ribbon guide, which is a bent frontal surface of the heat sink 4*d*, is formed as a separate part from the heat sink 4*d* of the thermal head 4 and is attached to the heat sink 4*d* with screws, the projecting parts 4*f* can be provided integrally with the ribbon guide, for example, as a bent portion that is bent onto above the heat sink 4*d*. Thus, there is no need to increase the number of parts of the thermal transfer printer by providing the projecting parts 4*f*.

In the first embodiment, the thermal head unit 4 is provided such that it can pivot about the support shafts 4*a* and while the thermal head unit 4 is mounted to the support shafts 4*a* such that it can move in the horizontal direction. Therefore, the thermal head unit 4 can be readily moved in the horizontal direction by the horizontal pressing force that is generated when the pressing member 7 contacts the protruding part 4*f*. As a result, the thermal head unit 4 can be made to touch against the positioning parts 11*a* and 12*a* in a reliable manner.

Second Embodiment

Figure 15:
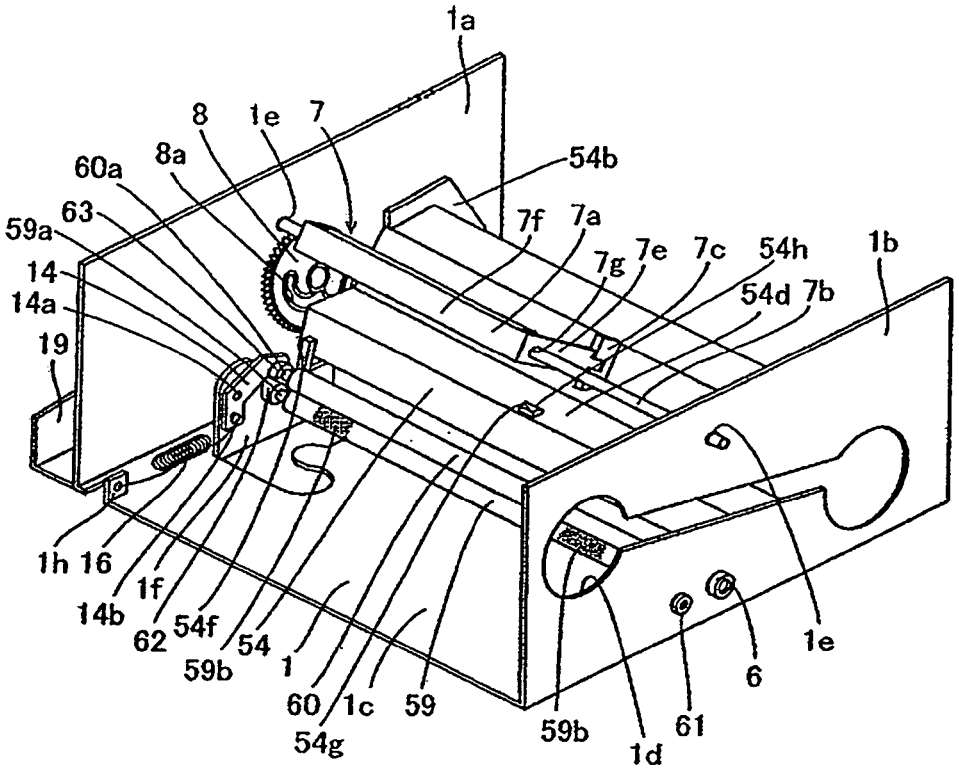
FIG. 15 is a perspective view showing the overall structure of a thermal transfer printer in accordance with a second embodiment of the present invention.
Figure 16:
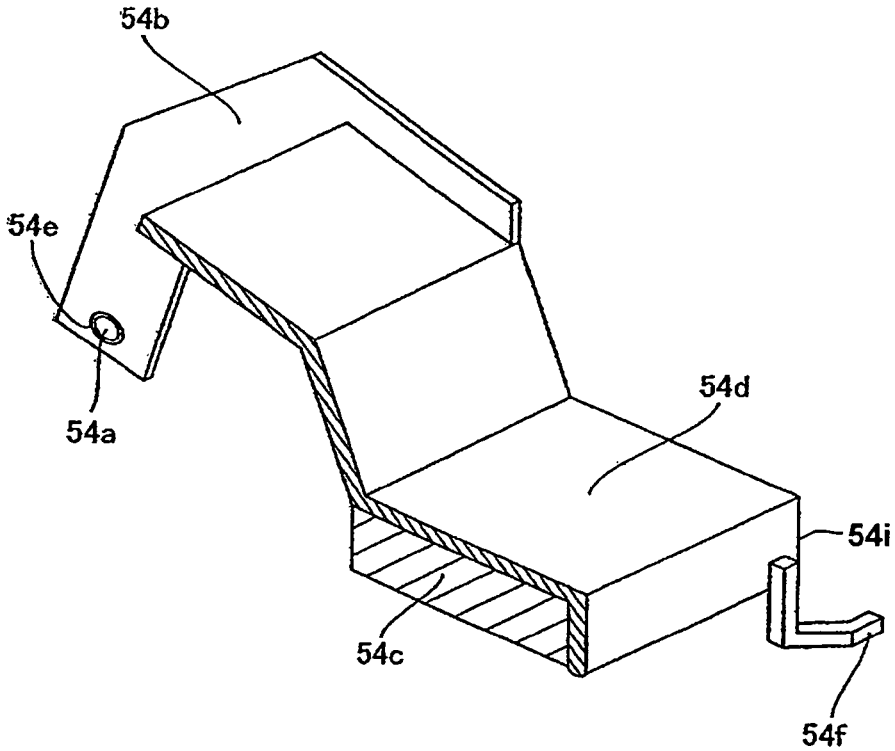
FIG. 16 is a partial cross sectional view of the thermal head unit of the thermal transfer printer in accordance with the second embodiment of the present invention shown in FIG. 15.
Figure 17:
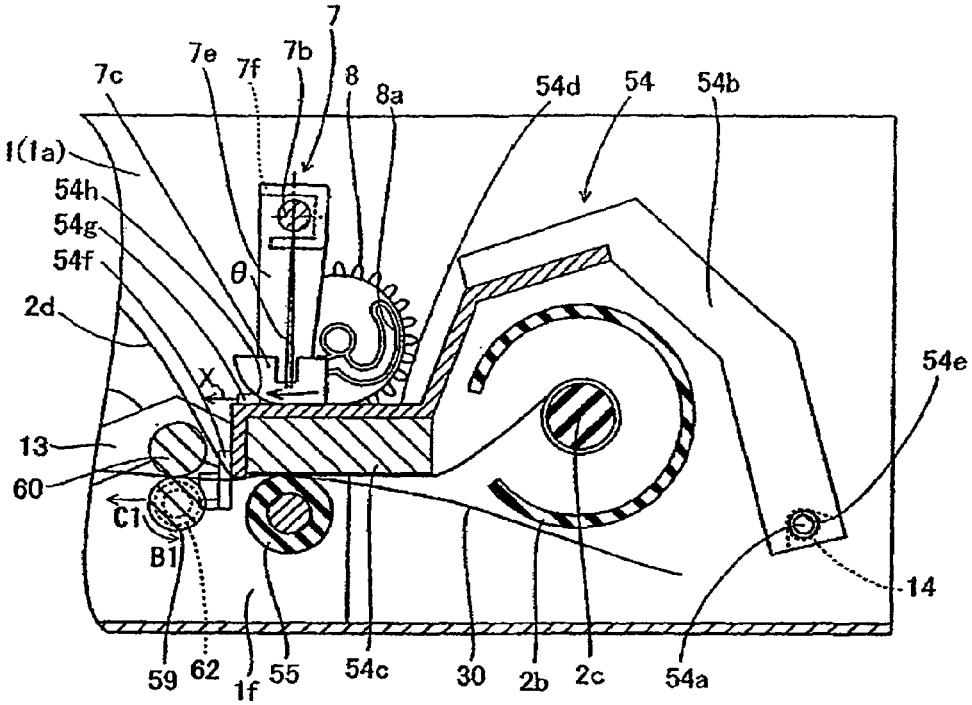
FIG. 17 is a schematic side view showing the thermal head unit being pressed by the pressing member in the thermal transfer printer in accordance with the second embodiment of the present invention shown in FIG. 15.
Figure 18:
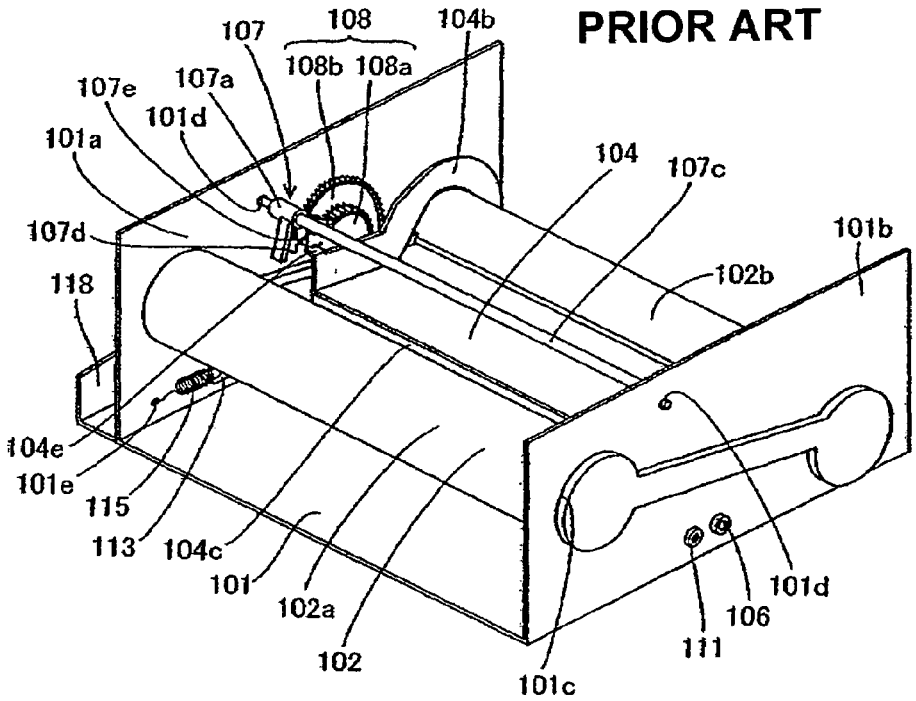
FIG. 18 is a perspective view showing the overall structure of a conventional example of a thermal transfer printer.
Figure 19:
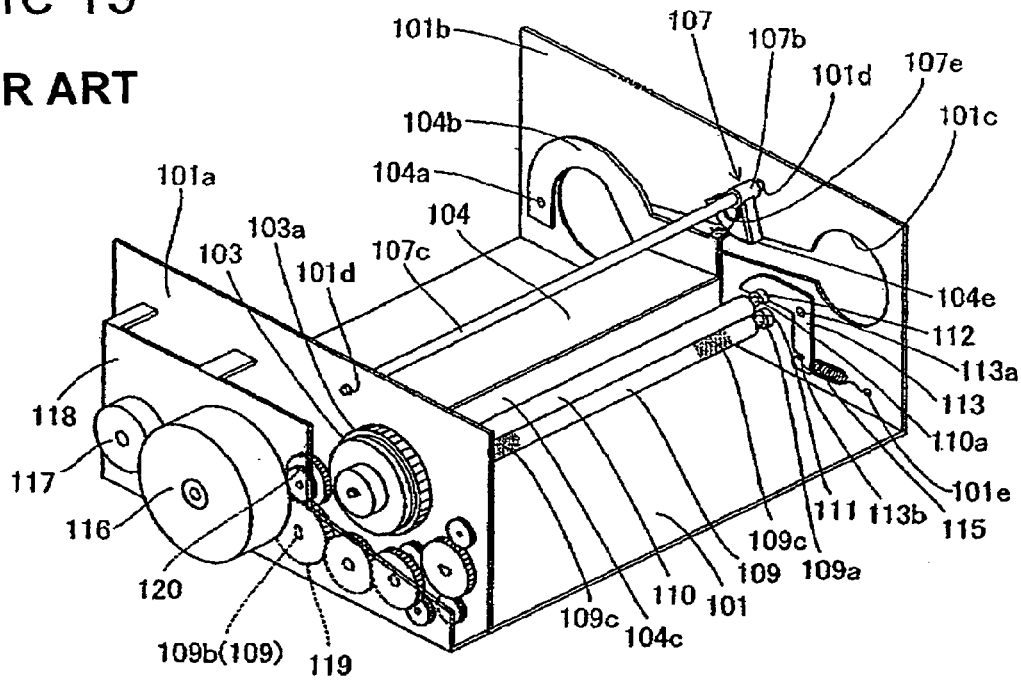
Figure 19 PRIOR ART
FIG. 19 is a perspective view of the thermal transfer printer shown in FIG. 18 with the ink ribbon cartridge being removed.
Figure 20:
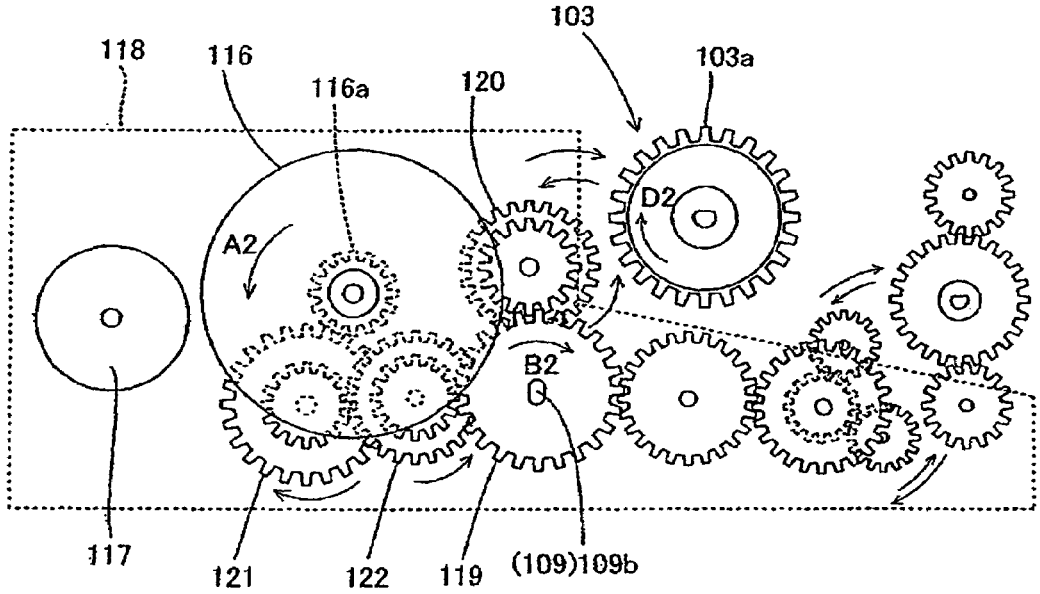
FIG. 20 is a side schematic view of the electric motors and gears of the thermal transfer printer shown in FIG. 18.
Figure 21:
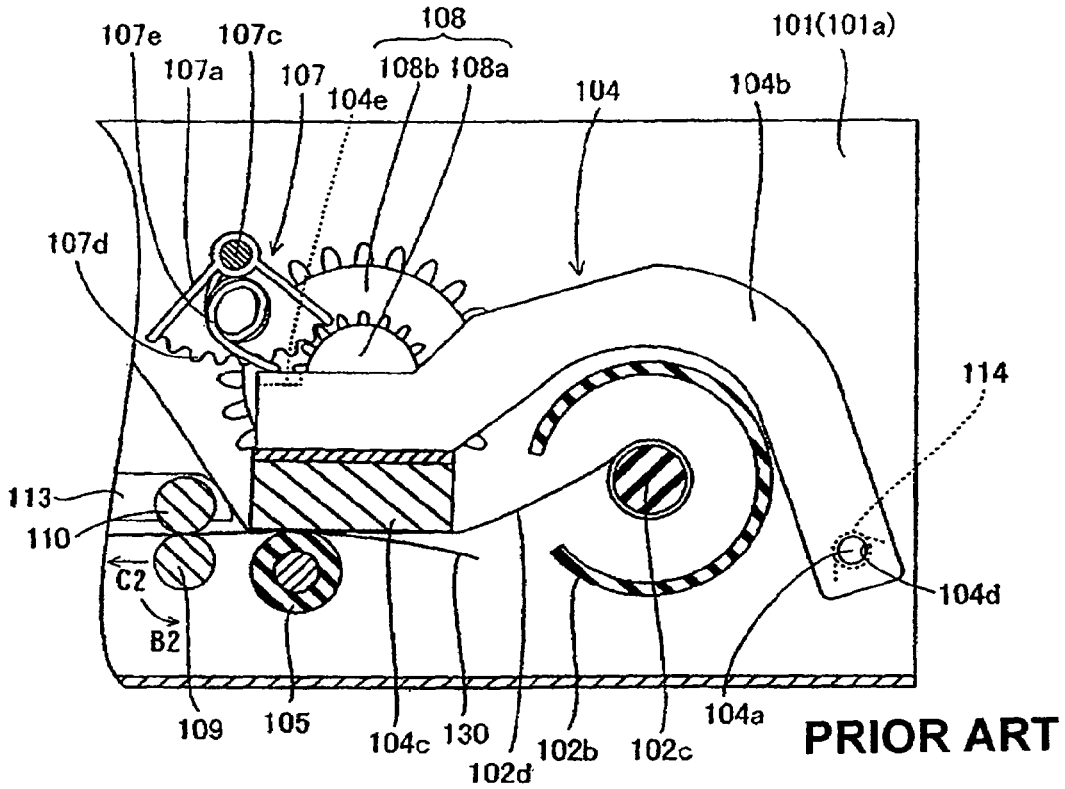
FIG. 21 is side schematic view of the thermal transfer printer shown in FIG. 18, showing the thermal head unit being pressed by the pressing member.
Figure 22:
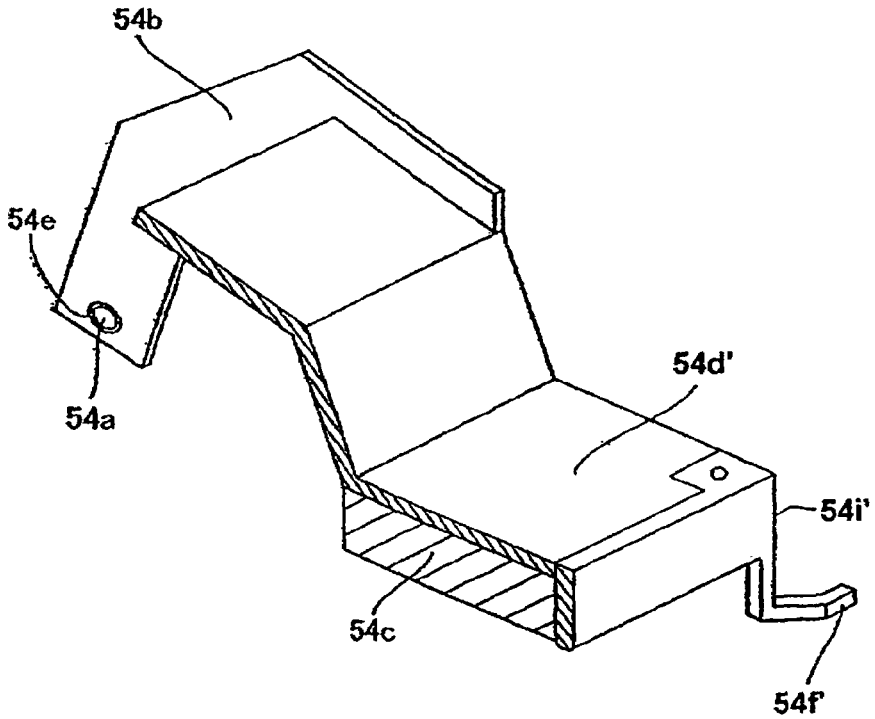
FIG. 22 is a partial cross sectional view of the thermal head unit of the thermal transfer printer in accordance with an alternate example of the second embodiment of the present invention.

FIG. 15 is a perspective view showing the overall structure of a thermal transfer printer in accordance with a second embodiment of the present invention. FIG. 16 is a partial perspective view of the thermal head unit of the thermal transfer printer in accordance with the second embodiment shown in FIG. 15. FIG. 17 is a schematic side view showing the thermal transfer printer in a pressed condition. FIG. 22 is a partial perspective view of the thermal head unit of the thermal transfer printer in accordance with an alternative configuration of the second embodiment. The second embodiment will now be explained with reference to FIGS. 15 to 17 and 22.

Unlike the first embodiment, the second embodiment has a projecting part that is provided on the heat sink of the thermal head unit and configured to contact the feed roller bearing. The structures of components of the thermal transfer printer of the second embodiment other than the thermal head unit, the feed roller, the pressing roller, the feed roller bearings, and the pressing roller bearings, are the same as those in the first embodiment. Thus, explanations of such components are omitted for the sake of brevity.

As shown in FIG. 15, in the thermal transfer printer in accordance with the second embodiment, the feed roller 59 has bearing support sections 59*a* of which the shaft diameters are smaller than the outermost diameter of the feed roller 59. The bearing support sections 59*a* of the feed roller 59 are rotatably supported on feed roller bearings 61 and 62. Printer paper feeding sections 59*b* are formed by form rolling on the surface of the feed roller 59 by forming protrusions of a prescribed height on the surface of the feed roller 59.

The pressing roller 60 has bearing support sections 60*a* of which the shaft diameters are smaller than the outermost diameter of the pressing roller 60*a*. The bearing support sections 60*a* of the pressing roller 60 are rotatably supported by pressing roller bearings 63.

As shown in FIGS. 16 to 17, the thermal head unit 54 has support shafts 54*a* that serve as the pivotal center for the thermal head unit 54, arm parts 54*b*, a thermal head 54*c*, a heat sink 54*d* for cooling the thermal head 54*c*, and support holes 54*e*. Projecting parts 54*f* that project in the horizontal direction and are configured to contact the feed roller bearings 61 and 62 are provided on a ribbon guide 54*i*, which is the front portion of the thermal head unit 54 and formed integrally with the heat sink 54*d* in this embodiment. The feed roller bearings 61 and 62 are examples of "positioning members" in accordance with the second embodiment of the present invention. In other words, the feed roller bearings 61 and 62 function as positioning members for the thermal head unit 54.

As shown in FIG. 15 and FIG. 17, the protruding part 54*g* is formed integrally and unitarily with the heat sink 54*d* of the thermal head unit 54 by, for example, press work. The protruding part 54*g* is arranged and configured to contact the cap part 7*c*, which is mounted on an end of the side plate 7*e* of the pivot member 7*a* of the pressing member 7. The protruding part 54*g* includes a contact part 54*h*, which is shaped to be able to achieve a two-dimensional contact with the surface of the cap part 7*c*.

In the second embodiment, the thermal transfer printer is provided with the pressing member 7 that is configured and arranged to press the thermal head unit 54 against the platen roller 55 by pushing against a top portion of the thermal head unit 54. The protruding part 54*g* is provided on the top portion of the thermal head unit 54, such that the pressing member 7 thereby exerts a force to the thermal head unit 54 and pushes the thermal head unit 54 in the horizontal direction when the pressing member 7 touches against the thermal head. Furthermore, the projecting parts 54*f* are arranged on the front portions of the thermal head unit 54.

Thus, when the pressing member 7 presses the thermal head unit 54 against the platen roller 55, the pressing member 7 and the protruding part 54*g* can cause the thermal head unit 54 to be pushed and moved in the horizontal direction in such a fashion that the projecting parts 54*f* of thermal head unit 54 touch against the feed roller bearings 61 and 62, which function as positioning members. Consequently, the thermal head unit 54 can be easily and stably positioned with respect to the platen roller 55 when the pressing member 7 pushes the thermal head unit 54. As a result, the print quality can be improved.

Additionally, since the projecting parts 54*f* provided on front portions of the thermal head unit 54 are formed integrally with the heat sink 54*d* of the thermal head unit 54, there is no need to increase the number of parts of the thermal transfer printer by providing the projecting parts 54*f*.

In a construction in which the ribbon guide 54*i* is formed as a separate part from the heat sink 54*d* of the thermal head 54, the projecting parts 54*f'* can be provided integrally with the ribbon guide 54*i'*, as shown in FIG. 22. Thus, there is no need to increase the number of parts of the thermal transfer printer by providing the projecting parts 54*f'*.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

For example, although the foregoing first and second embodiments present thermal transfer printers as examples of an image forming device, the present invention is not limited to thermal transfer printers. In addition to thermal transfer printers, the present invention can be applied to any other image forming device having a thermal head unit and a feed roller bearing.

In the foregoing first and second embodiments, the protruding part provided on the heat sink of the thermal head unit is arranged such that when the pressing member pivots toward the pivot endpoint (pressing position), the cap part provided on the end part of the side plate of the pivot member of the pressing member contacts the protruding part immediately before the pressing member reaches the pivot endpoint (pressing position). However, the present invention is not limited to such an arrangement. It is also acceptable for the protruding part to be arranged such that the cap part of the pressing member contacts the protruding part at a position other than a position immediately before the pivot endpoint (pressing position).

Although in the foregoing first and second embodiments, the protruding part is provided as an integral part of the heat sink of the thermal head unit, the present invention is not limited to such construction. It is acceptable for the protruding part to be provided as a separate entity that is attached to the heat sink.

Although in the foregoing second embodiment, the projecting parts for contacting the feed roller bearings are provided as an integral part of the heat sink, the present invention is not limited to such construction. It is acceptable for the projecting parts to be provided as separate parts that are attached to the ribbon guide.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2005-087802. The entire disclosure of Japanese Patent Application No. 2005-087802 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image forming device, comprising:

a chassis;

a thermal head unit pivotably supported by the chassis for executing printing;

a platen roller supported by the chassis opposite the thermal head unit;

a pressing member that is pivotably supported by the chassis and configured to press the thermal head unit against the platen roller by pushing against a top portion of the thermal head unit;

a protruding part that is provided on the top portion of the thermal head unit and configured to engage the pressing member in a horizontal direction as the pressing member is pivoted to press the thermal head unit against the platen roller; and a positioning member configured to engage the thermal head unit as the thermal head unit is pushed in the horizontal direction due to the engagement of the protruding part with the pressing member in the horizontal direction.

2. The image forming device recited in claim 1, wherein the protruding part is arranged such that the pressing member is configured to engage the protruding part in the horizontal direction before the pressing member reaches the pivot endpoint as the pressing member pivots toward its pivot endpoint.

3. The image forming device recited in claim 1, further comprising:

a feed roller rotatably supported by the chassis for feeding printer paper; and a feed roller bearing supported by the chassis and configured to rotatably support the feed roller, the positioning member being formed on the feed roller bearing.

4. The image forming device recited in claim 1, wherein the protruding part is formed integrally with the thermal head unit.

5. The image forming device recited in claim 1, wherein the thermal head unit is pivotably mounted to the chassis with a support shaft so as to be further movable in the horizontal direction.

6. The image forming device recited in claim 1, wherein the positioning member has a projecting part that projects in the horizontal direction formed thereon, the projecting part being configured to engage the thermal head unit as the thermal head unit is pushed in the horizontal direction.

7. The image forming device recited in claim 1, wherein the thermal head unit has a projecting part that projects in the horizontal direction formed thereon, the projecting part being configured to engage the positioning member as the thermal head unit is pushed in the horizontal direction.

8. An image forming device, comprising:

a chassis;

a thermal head unit pivotably supported by the chassis for executing printing;

a platen roller supported by the chassis opposite the thermal head unit;

a pressing member that is pivotably supported by the chassis and configured to press the thermal head unit against the platen roller by pushing against a top portion of the thermal head unit;

a protruding part that is provided on the top portion of the thermal head unit and configured to engage the pressing member in a horizontal direction as the pressing member is pivoted to press the thermal head unit against the platen roller;

a positioning member configured to engage the thermal head unit as the thermal head unit is pushed in the horizontal direction due to the engagement of the protruding part with the pressing member in the horizontal direction;

a feed roller rotatably supported by the chassis for feeding printer paper; and a feed roller bearing supported by the chassis and configured to rotatably support the feed roller, wherein the positioning member is formed on the feed roller bearing, and the protruding part is arranged such that the pressing member is configured to engage the protruding part in the horizontal direction before the pressing member reaches the pivot endpoint as the pressing member pivots toward its pivot endpoint.

* * * * *